US006983499B2

(12) United States Patent
Gladney

(10) Patent No.: US 6,983,499 B2
(45) Date of Patent: Jan. 10, 2006

(54) ADJUSTABLE BED SHIELDS

(75) Inventor: Richard F. Gladney, Fairburn, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

(21) Appl. No.: 10/442,512

(22) Filed: May 21, 2003

(65) Prior Publication Data

US 2004/0231052 A1 Nov. 25, 2004

(51) Int. Cl.
*A61G 7/015* (2006.01)
*A61G 7/05* (2006.01)

(52) U.S. Cl. ..... 5/424; 5/600; 5/618
(58) Field of Classification Search ..... 5/424, 5/617, 618, 600, 658
See application file for complete search history.

(56) References Cited

U.S. PATENT DOCUMENTS 3,667,075 A 6/1972 Ballard et al.
5,224,228 A * 7/1993 Larrimore ..... 5/613
5,528,782 A * 6/1996 Pfeuffer et al. ..... 5/611
6,505,364 B2 * 1/2003 Simmons et al. ..... 5/600

* cited by examiner

*Primary Examiner*—Alexander Grosz
(74) *Attorney, Agent, or Firm*—Fish & Neave IP Group Ropes & Gray, LLP

(57) ABSTRACT

Presently described are several alternate embodiments for shield devices to enclose and thereby prevent entrapment of objects in the interior space formed by elements of an adjustable bed in the raised position. Such shield devices may include physical barriers. In other embodiments, the shield may include optical sensors that provide rapid detection of intruding objects, thereby activating controls that preclude the further movement of the adjustable bed mechanism. In a further embodiment, an operative shield may be provided by means of a specially adapted controller configured such that only an authorized user can cause the adjustable bed to operate, thereby preventing the possibility that the bed could be operated while any object has intruded into the interior space.

6 Claims, 3 Drawing Sheets

ADJUSTABLE BED SHIELDS

BACKGROUND OF THE INVENTION

1. Field of the Invention

The present invention relates to protective guards and safety sensors for use with adjustable bed mechanisms.

2. Description of the Related Art

Certain classes of adjustable beds are well known in the art, typified by conventional fully-articulated hospital beds made by Maxwell and Hill-Rom. These beds generally consist of open steel frames with numerous articulating arms to raise or lower the entire bed platform, the head area, and/or the foot area. Such beds are very heavy and very expensive.

There has been a recent trend in the consumer market to introduce a degree of adjustability into consumer beds for home use. These beds are generally lighter and more compact. There is a risk, however, that the adjustable elements, such as the head or foot portion of the bed, may leave exposed open cavities which can entrap bedclothes or other objects.

What is needed is an apparatus to enclose or otherwise protectively screen off the interior spaces of consumer-market adjustable beds. Preferably such an apparatus is simple to install yet difficult to defeat.

SUMMARY

Presently described are several alternate embodiments for a shield apparatus to enclose the interior spaces or cavities formed in adjustable beds when their sleeping surfaces are in the raised (up) position. These shield devices may include both physical barriers that prevent any object from intruding into the open space formed by raised portions of an adjustable bed as well as optical sensors that provide near-instantaneous detection of object intrusion and automatic cessation of further articulation or movement of the adjustable bed. In a further embodiment, the shielding function may be achieved by means of a controller that only authorized users are able to access and thereby cause the adjustable bed to articulate. Such an embodiment precludes the possibility that the bed could be operated while any object has intruded into the bed space and thus prevent entrapment therein.

BRIEF DESCRIPTION OF THE DRAWINGS

The present disclosure may be better understood and its numerous features and advantages made apparent to those skilled in the art by referencing the accompanying drawings.

The use of the same reference symbols in different drawings indicates similar or identical items.

DETAILED DESCRIPTION

In one type of consumer adjustable bed system, the sleeping surface actuation mechanism is fully enclosed within a bed platform. This bed platform then fits directly into a conventional bed frame so that, when the bed is in a flat or retracted position it looks just as any other normal bed or mattress. When actuated by a controller, however, the head and/or the foot can be raised (or articulated) independently of one another or the rest of the sleeping surface.

Raising the head or the foot area leaves an open space between the raised mattress (the "sleeping surface") and the interior of the bed frame. The articulation mechanism is thus exposed within the open space. If the mechanical designs of an adjustable bed mechanism leaves the spaces between articulating components accessible in such situations, the risk of an entrapment hazard may arise. While electronic controls designed to prevent excess pressure from being applied by the electric motors conventionally employed for articulation are well known, such devices do not prevent entrapment; they can only limit the severity of injury.

Figure 1:
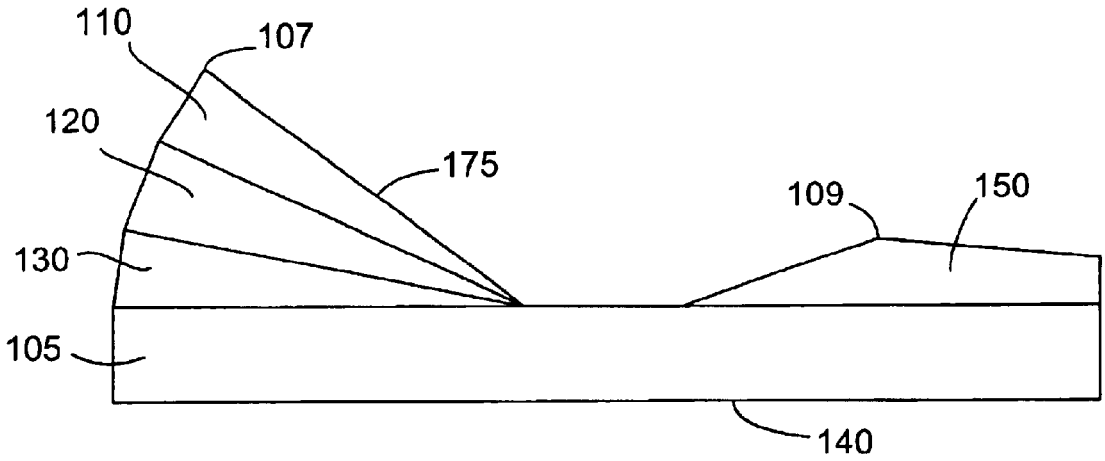
FIG. 1 is a side view of an adjustable bed employing a rigid or semi-rigid shield, according to one embodiment of the present invention.

In accordance with several embodiments of the present invention, a new concept in adjustable bed shielding is herein described. In a first embodiment, shown in FIG. 1, a set of rigid, interlocking guard members 110, 120, and 130 are placed around the head end 107 of the bed, such that when the head is raised the "clamshell" or nested interlocking sections 110–130 extend to block off all access at the head of the bed and on both adjacent sides to the interstitial space between the sleeping surface 175 and the bed frame 105. Clamshell sections 110, 120 and 130 (shown here as three sections only for purposes of clarity; one of ordinary skill in the art will recognize that more or fewer sections could also be used) are shown in the up, articulated position.

Bed frame 105 is further protected by bottom guard 140 so that objects or people cannot enter into the shielded mechanism area within bed frame 105 and guard sections 110 through 130. Likewise, on an adjustable bed equipped with an articulating foot section 109, a similar foot guard 150, which may be composed of one or more interlocking and or nested members such as sections 110, may be employed. In this way, a person resting on sleeping surface 175 may adjust, through use of a remote control (not shown), the bed into any comfortable position. At the same time, however, the open spaces underneath the sleeping surface and inside the bed frame 105 are protected by guard panels 110 through 130, 140, and 150.

The guard sections 110 through 130 and 150 may be composed of rigid polymer or other plastic material. Alternatively, heavy textile fabrics for other stiff and impenetrable materials may be used. Flexibility and impenetrability are desirous because the guards need to move repeatedly over the lifetime of the adjustable bed, yet they must not allow objects to poke through into the shielded space. In this context, the undesirable "poke through" includes perforation as well as flexible deformation of the shield material such at the deforming object enters the shielded space and is thus placed in danger of entrapment. In general, a desirable feature of such guard materials is that any pressure placed upon them should not allow the pressing object to intrude into the articulating mechanism in any way.

Bottom guard 140 may also be composed of rigid polymer or textile fabric material. As bottom guard 140 extends across a substantially flat surface, a number of materials may be used as are conventionally seen in closing out the bottoms of box springs or bed components.

Figure 2:
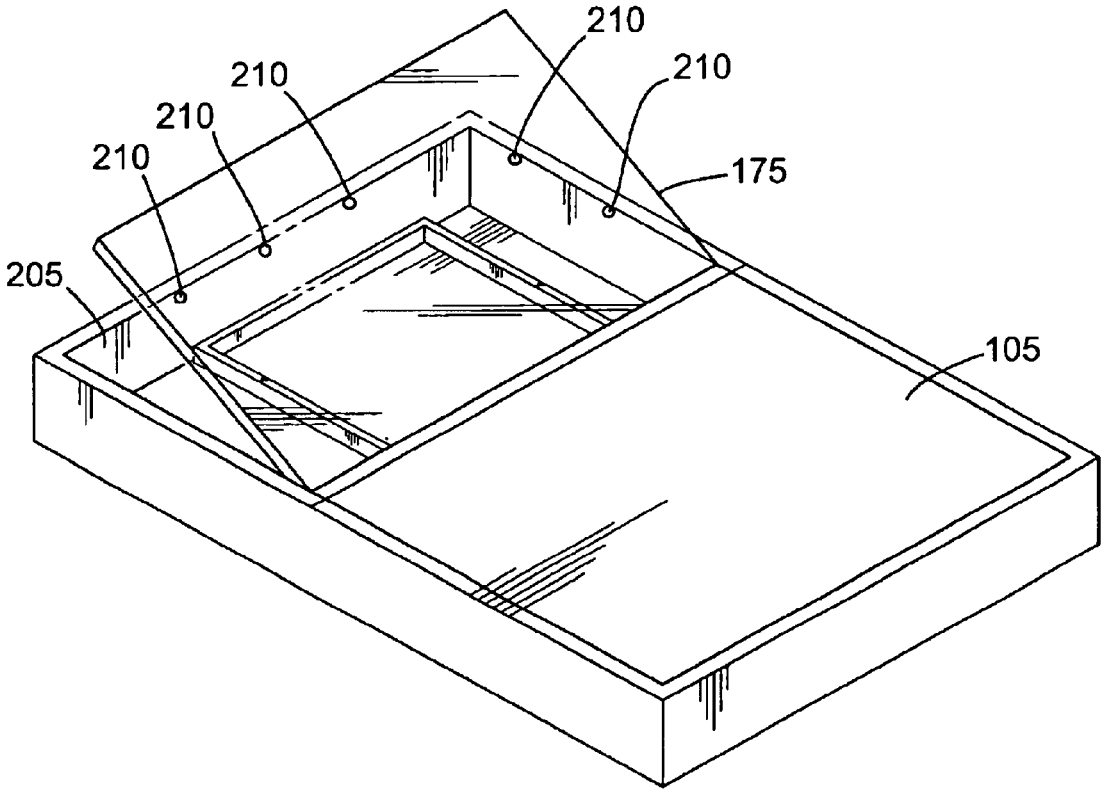
FIG. 2 is an isometric view of an adjustable bed employing a light curtain shield, according to one embodiment of the invention.

FIG. 2 shows an alternate embodiment for an adjustable bed shield mechanism. Here bed 105 is shown in semi transparent form so that one can see through sleeping surface 175 to the interior of the adjustable bed mechanism space 205. Sensors 210 mounted inside bed 105 are activated when sleeping surface 175 is raised. FIG. 2 shows only the head portion of sleeping surface 175, for clarity. Sensors 210, which may comprise from one to ten or even more sensors, provide an optical curtain between the edge of bed frame 105 and the lower portion of sleeping surface 175. "Optical curtain" is here understood to mean any web or set of optical sensors, although a continuous field is not necessary nor implied.

Sensors 210 may be conventional optical emitter/detector units as are commonly used in industrial controls and safety systems. For example, as required by current federal law, all garage door openers must have "electric eye" sensors that both emit and detect an optical beam. If the beam is interrupted, circuitry within the opener systems prevent the door from closing. Some of these sensors are commonly known to use a combined beam emitter/detector unit on one side of the opening and a reflector on the other, so that the emitted beam is reflected back to the receiver when the opening is clear of obstructions. Other conventional systems employ separate emitter and detector pairs. Although a combined emitter/detector and reflector combination is described herein, those skilled in the art will realize that emitters and detectors in various conventional configurations can be used. Accordingly, the invention is not limited to any particular type of optical sensor.

In an exemplary embodiment, when a user attempts to lower an articulated portion of the bed (e.g., the head or the foot) and the beam in any one of optical sensors 210 is interrupted, the articulation mechanism stops, thereby preventing entrapment.

It should be understood in this context the use of the terms electric eye, light curtain, or optical sensor are interchangeable. All of these devices function by means of one or more optical beams and one or more detectors that sense the presence of the beam(s) emitted by one or more distant emitters, as described above. In operation, such sensors typically provide a "closed circuit" or "safe" signal when the beam is emitted and received. That signal ceases or is interrupted when the beam is interrupted. This may occur either because the beam emitter has failed or the receiver can no longer see the beam, as when something has interposed itself between the emitter and the receiver. Regardless of the cause of the interruption of the signal, a mechanism conventionally controlled or regulated by such sensor devices then ceases operating.

Figure 3:
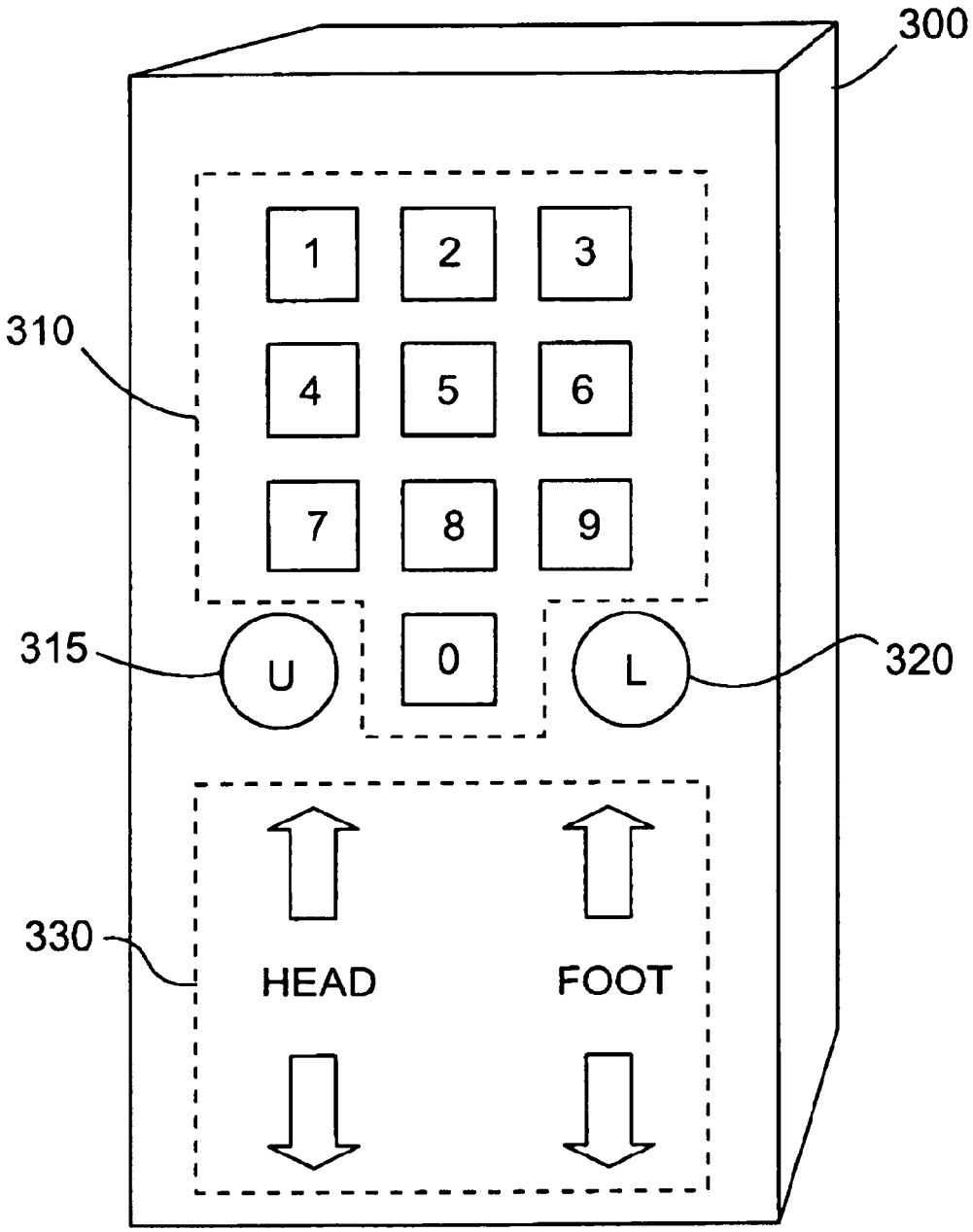
FIG. 3 is schematic representation of a access key-coded remote control, according to one embodiment of the present invention.

In the third embodiment of a shielding apparatus for an adjustable bed, the above-described conventional remote control may be modified so that it can only be operated by authorized users. As well-known in the art, remote controls (either wired or wireless) are often used with adjustable beds. However, in the hospital bed context, such devices are often kept out of reach of patients and are not available to the casual user. In the context of a consumer product, however, an additional measure of safety is desired. Accordingly, in one embodiment of the present invention, a specialized remote control is adapted to require the entry of a key code or "PIN" number in order to unlock the movement functions of the bed. FIG. 3 shows a rough schematic mock-up of such a modified remote control. Those of ordinary skill in the art may of course recognize that remote controls may take many shapes and forms. The necessary features described with regard to FIG. 3 can therefore appear under many different guises and still fall within the scope and spirit of the present invention.

Remote control 300 consists of a numeric key pad area 310 shown by a dotted line, unlock key 315, and lock key 320. In an exemplary embodiment, when the user enters a multi-digit PIN code with key pad 310 and depresses the unlock key 315, articulation control buttons 330 are activated and the bed may be adjusted. In some embodiments, after a preset time-out the unit reverts to a locked state. In an alternative embodiment, the unit can be left unlocked by the user and locked simply by depressing the locked key at any time, so that user may prevent children or other unauthorized persons from adjusting the bed.

Although a remote control device in the general form of a television remote is shown, one of ordinary skill in the art will recognize that many other forms are possible. For example (and not by way of limitation), remotes using biometric or fingerprint identification could be programmed ("keyed") to individual users, thereby eliminating the need for keypads. Switches, such as the well-known rocker switch, instead of a keypad could also be used. Alternatively, knobs, dials, or studs could be manipulated in a pattern to unlock the remote control functions. In a further alternate embodiment, a remote control mechanism similar to mechanism 300 shown in FIG. 3 may be fitted with a special mechanical key device so that it can only be operated when a physical key is in place. In such embodiments, the user can disable the bed by simply removing the key and storing it in a safe place. Accordingly, the scope of the invention is not limited to any single form of lockable remote control that can render an adjustable be inoperative.

While particular embodiments of the present invention have been shown and described, it will be apparent to those skilled in the art that changes and modifications may be made without departing from this invention in its broader aspect and, therefore, the appended claims are to encompass within their scope all such changes and modifications as fall within the true spirit of this invention.

I claim:

1. An apparatus for shielding the inner works of an adjustable bed, said adjustable bed having a frame having external dimensions corresponding to a sleeping surface for a person, and a moveable sleeping support section that articulates relative to said frame, comprising:

a plurality of overlapping nested shield members, said plurality of shield members comprising a lower edge and an upper edge;

a first mounting means for attaching said lower edge to said frame; and a second mounting means for attaching said upper edge to said moveable sleeping support section;

wherein said plurality of overlapping shield members cooperate with each other so that they remain overlapping through said articulation of said moveable sleeping support section element, defining thereby a shielded space within said frame, said plurality of overlapping shield members and said moveable sleeping support section.

2. The apparatus of claim 1, wherein said overlapping shield members encompass the head and at least an adjacent portion of each of the two sides of said bed.

3. The apparatus of claim 1, wherein said overlapping shield members encompass the foot and at least an adjacent portion of each of the two sides of said bed.

4. An apparatus for shielding the inner works of an adjustable bed, said adjustable bed having a frame with external dimensions corresponding to a sleeping surface for a person, and a moveable sleeping support section that articulates relative to said frame, comprising:

a flexible but imperforated shield member comprised of a plurality of overlapping nested elements, said shield member comprising a lower edge and an upper edge;

a first mounting means for attaching said lower edge to said frame; and a second mounting means for attaching said upper edge to said moveable sleeping support section;

wherein said flexible shield member in cooperation with said frame and said moveable sleeping support section define a shielded space throughout said articulation of said moveable sleeping support section.

5. The apparatus of claim 4, wherein said shield member encompasses the head and at least an adjacent portion of each of the two sides of said bed.

6. The apparatus of claim 4, wherein said shield member encompasses the foot and at least an adjacent portion of each of the two sides of said bed.

* * * * *